US008393659B2

(12) United States Patent
Stroh

(10) Patent No.: US 8,393,659 B2
(45) Date of Patent: Mar. 12, 2013

(54) MATERIAL HANDLING SYSTEM

(76) Inventor: Brad Stroh, Waterloo, IA (US)

( * ) Notice: Subject to any disclaimer, the term of this patent is extended or adjusted under 35 U.S.C. 154(b) by 0 days.

(21) Appl. No.: 13/065,496

(22) Filed: Mar. 23, 2011

(65) Prior Publication Data

US 2012/0242101 A1 Sep. 27, 2012

(51) Int. Cl.
*B66C 1/00* (2006.01)

(52) U.S. Cl. ..... 294/67.3; 294/81.5; 294/67.33

(58) Field of Classification Search ..... 294/81.5, 294/67.3, 67.33, 67.1, 81.54
See application file for complete search history.

(56) References Cited

U.S. PATENT DOCUMENTS 1,865,739 A * 7/1932 Bergmann ..... 294/81.5
2,676,835 A * 4/1954 McKinney ..... 294/74
2,696,317 A * 12/1954 Toffolon ..... 414/607
2,793,905 A * 5/1957 Hillyer ..... 294/74
3,097,011 A 7/1963 Foster
4,103,812 A * 8/1978 Steiner ..... 294/165
4,162,804 A 7/1979 Davies
4,187,711 A 2/1980 Lavochkin et al.
4,404,740 A * 9/1983 Hagg et al. ..... 29/606
4,781,509 A * 11/1988 Evans ..... 414/791
4,826,228 A * 5/1989 Dinitz et al. ..... 294/81.56
4,969,780 A 11/1990 Hermsted
4,973,094 A * 11/1990 Tana et al. ..... 294/81.21
5,445,426 A * 8/1995 Sorensen ..... 294/67.3
5,501,497 A * 3/1996 Holloway ..... 294/86.4
6,086,126 A 7/2000 Krauss
7,329,082 B2 2/2008 Warren

* cited by examiner

*Primary Examiner* — Saul Rodriguez
*Assistant Examiner* — Gabriela Puig
(74) *Attorney, Agent, or Firm* — Brett J. Trout

(57) ABSTRACT

A material handling system for engaging and lifting transformer coils. Four leg assemblies are provided around a transformer. The leg assemblies have extensible plates which extend underneath the transformer. The leg assemblies are secured by chains to an overhead cruciform spacer which is coupled to a crane or other device. The leg assemblies may be bound together by straps to prevent movement of the leg assemblies relative to one another. For smaller or larger transformers, a lesser or greater number of leg assemblies may be used.

18 Claims, 5 Drawing Sheets

MATERIAL HANDLING SYSTEM

TECHNICAL FIELD

The present invention relates in general to a material handling system and, more particularly, to a system for lifting transformer coils.

BACKGROUND

Industrial electrical transformer coils are provided with large windings of a conductive sheet metal. The transformer coils may be constructed of a single wound sheet, or may be constructed of multiple windings. The windings may also form multiple cylinders, which nest inside one another, with the cylinder of windings having the smallest diameter forming the interior of the transformer coil and the cylinder of windings having the largest diameter forming the exterior of the transformer coil. Although large transformer coils can weigh five tons or more, the windings are relatively delicate and subject to damage if the transformer coils are lifted or moved improperly.

It is known in the prior art to provide large, dedicated lifting systems to secure and transport transformer coils. Such systems are useful for dismantling transformers when they have failed to determine the root cause of a transformer failure. To properly diagnose a failure, prior art systems are designed to dismantle the failed transformers with minimal distortion of the transformers" inner coils. While such systems are useful in a closed environment, such as a transformer coil manufacturing facility, such systems are not portable. These lifting systems are also too large and expensive to be used on an installation site.

While it is possible to place a transformer coil on a platform and use prior art technology to lift the platform with the transformer coil provided thereon, such a platform would limit underneath access to the interior of the coil. It would be desirable to provide a system for lifting the transformer coil which left the axial center of the transformer coil exposed, to allow the transformer coil to be positioned over a core leg. While it would be possible to provide an opening in the platform on which the transformer coil is placed, once the transformer coil is positioned over, the core leg, it would be difficult to remove the platform from the core leg with the transformer coil in position over the platform.

It is also known in the art to employ screw clamps, such as those described in U.S. Pat. No. 4,404,740 to lift a transformer coil. In this type of system, screw clamps having top and bottom clamps are secured to a transformer coil. Threaded bolts running the length of the screw clamps are used to tighten the screw clamps, drawing the bottoms of the screw clamps toward the tops of the screw clamps, and securing the transformer coil therebetween. A plurality of such screw clamps may be secured to the transformer coil. Chains are thereafter secured to the screw clamps and a crane or other lifting device lifts the chains.

While such systems are useful for the lifting of the transformer coil or maintaining the axial core of the transformer coil exposed so that it may be placed over a core leg, such systems have several drawbacks. One drawback associated with such prior art systems is the difficulty involved with installing the screw clamps. To install the screw clamps, the transformer coil must be lifted a substantial distance to accommodate the bottom of the screw clamps. Additionally, after the screw clamps are provided under and over the transformer coil, the threaded bolts of the screw clamps must be individually tightened to prevent the screw clamps from being dislodged.

Another disadvantage of such systems is that the screw clamps are allowed to move independently of one another, thereby exposing the transformer coil to damage if one of the screw clamps were to fail and the remaining screw clamps not being connected or sufficiently coordinated to accommodate the additional weight the failed screw clamp is no longer able to support. Additionally, once the transformer coil is provided over the core leg, the difficulties associated with attaching the screw clamps exists in reverse, with the transformer coil having to be lifted a substantial distance to remove the screw clamps and the individual threaded rods of the screw clamps having to be individually adjusted to allow the screw clamps to be removed from the transformer coil. The size and complexity of the screw clamps also increases the maintenance and potential failure rate of the entire system.

In material handling situations such as lifting and moving a transformer coil, it would be desirable to provide a lightweight and efficient system for securing a transformer coil, lifting the transformer coil, moving the transformer coil and removing the lifting system once the transformer coil has been positioned as desired. It would also be desirable to provide a lifting system that secured the transformer coil in a manner that adjusted the load in the event of the failure of one portion of the lifting system. It would also be desirable to provide a lifting system that was adjustable to lift a single transformer coil cylinder or multiple transformer coil cylinders without having to completely remove the material handling system from the transformer coil. Furthermore, it would be desirable to provide a material handling system for lifting and moving transformer coils that is of a low-cost, lightweight and low maintenance design.

The difficulties encountered in the prior art discussed hereinabove are substantially eliminated by the present invention.

SUMMARY OF THE DISCLOSED SUBJECT MATTER

Advantageously, in a preferred example of this invention, a material handling system is provided with a plurality of legs secured around an electrical transformer coil with a strap. Each of the legs is provided with a shoe, defining a slot through which is provided an adjustable foot. The foot may be extended or retracted from the shoe a predetermined distance to allow the material handling system to lift one or more cylinders of the transformer coils simultaneously. The legs are coupled to a cruciform spacer by a plurality of lift lines, to allow the lifting system to be lifted by a crane or similar device without causing damage to the transformer coil. Once the transformer coil has been lifted and positioned as desired, the straps and legs may be removed from the transformer coil.

BRIEF DESCRIPTION OF THE DRAWINGS

The present invention will now be described, by way of example, with reference to the accompanying drawings in which.

DETAILED DESCRIPTION OF THE DRAWINGS

Figure 1:
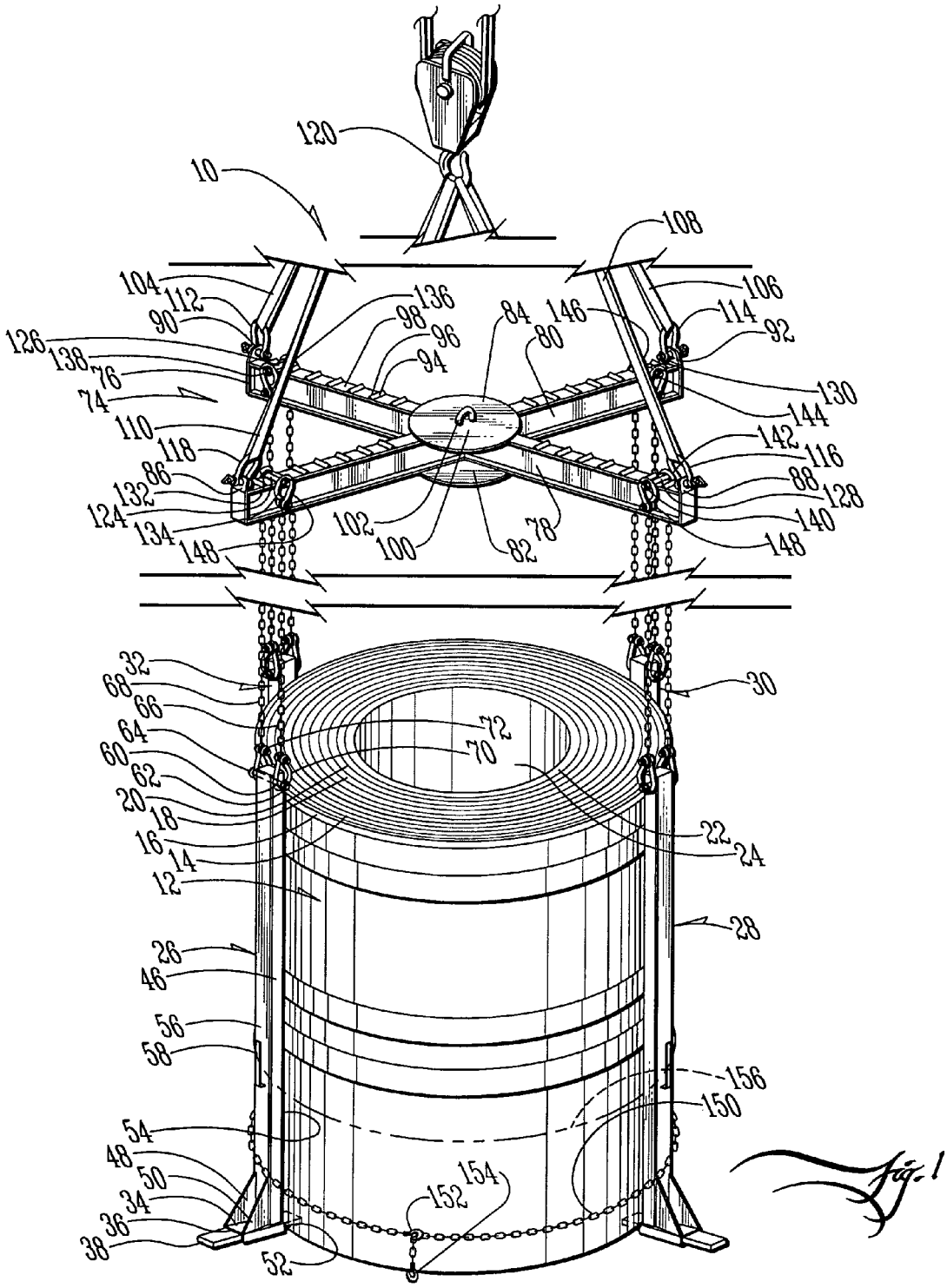
FIG. 1 is a top perspective view of the material handling system of the present invention lifting a coil transformer.
Figure 2:
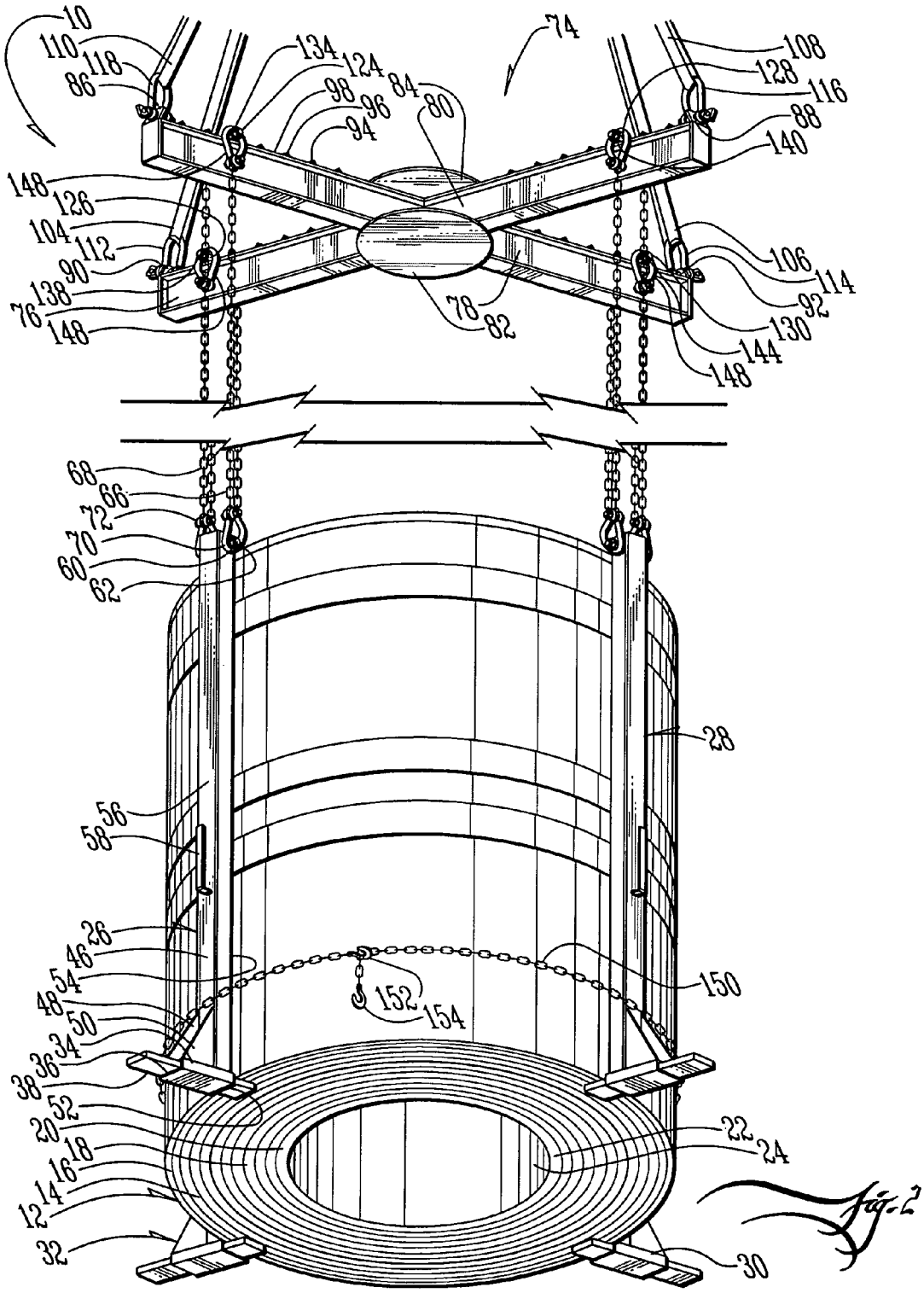
FIG. 2 is a bottom perspective view of the material handling system of the present invention lifting a coil transformer in accordance with one embodiment.
Figure 3:
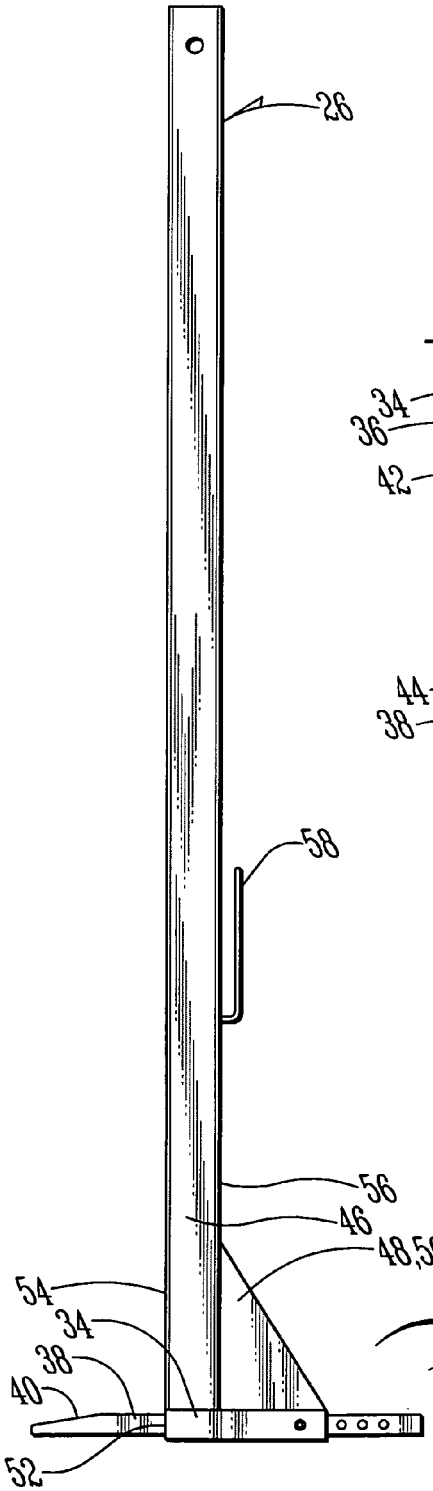
FIG. 3 is a side elevation of the leg assembly of the material handling system of the present invention in accordance with one embodiment.

A material handling system according to this invention is shown generally as (10) in FIG. 1. The system (10) is provided around a transformer coil (12). The transformer coil (12) is constructed of a first winding (14) defining an exterior cylinder (16) having a first interior (18). Provided within the first interior (18) is a second winding (20) defining an interior cylinder (22) having a second interior (24). The material handling system (10) is provided with a first leg assembly (26), a second leg assembly (28), a third leg assembly (30) and a fourth leg assembly (32). As the leg assemblies (26-32) are preferably identical in construction, description will be limited to a first leg assembly (26).

Figure 4:
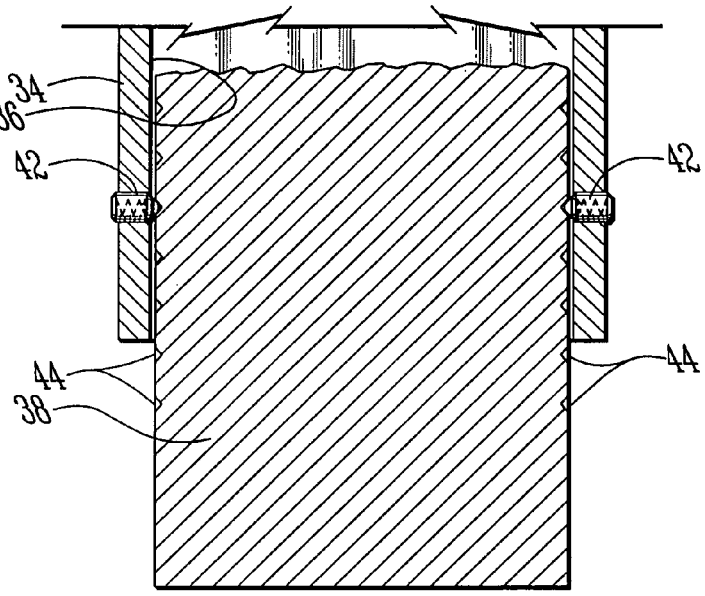
FIG. 4 is a top elevation in cross-section of the interior of the shoe of the leg assembly of the present invention in accordance with one embodiment.
Figure 5:
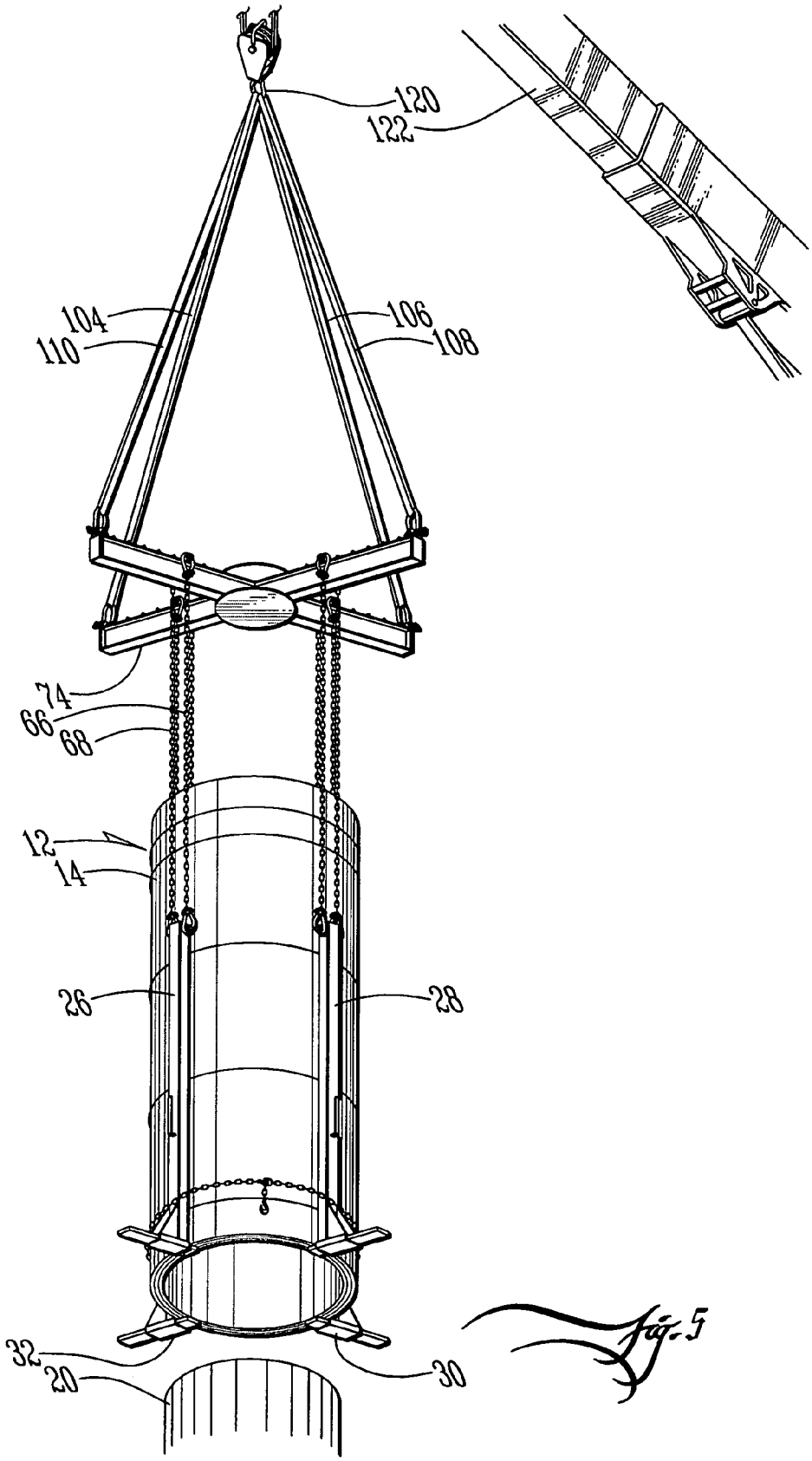
FIG. 5 is a bottom perspective view of the material handling system of the present invention lifting an outer winding of a coil transformer off of an inner winding in accordance with one embodiment.
Figure 6:
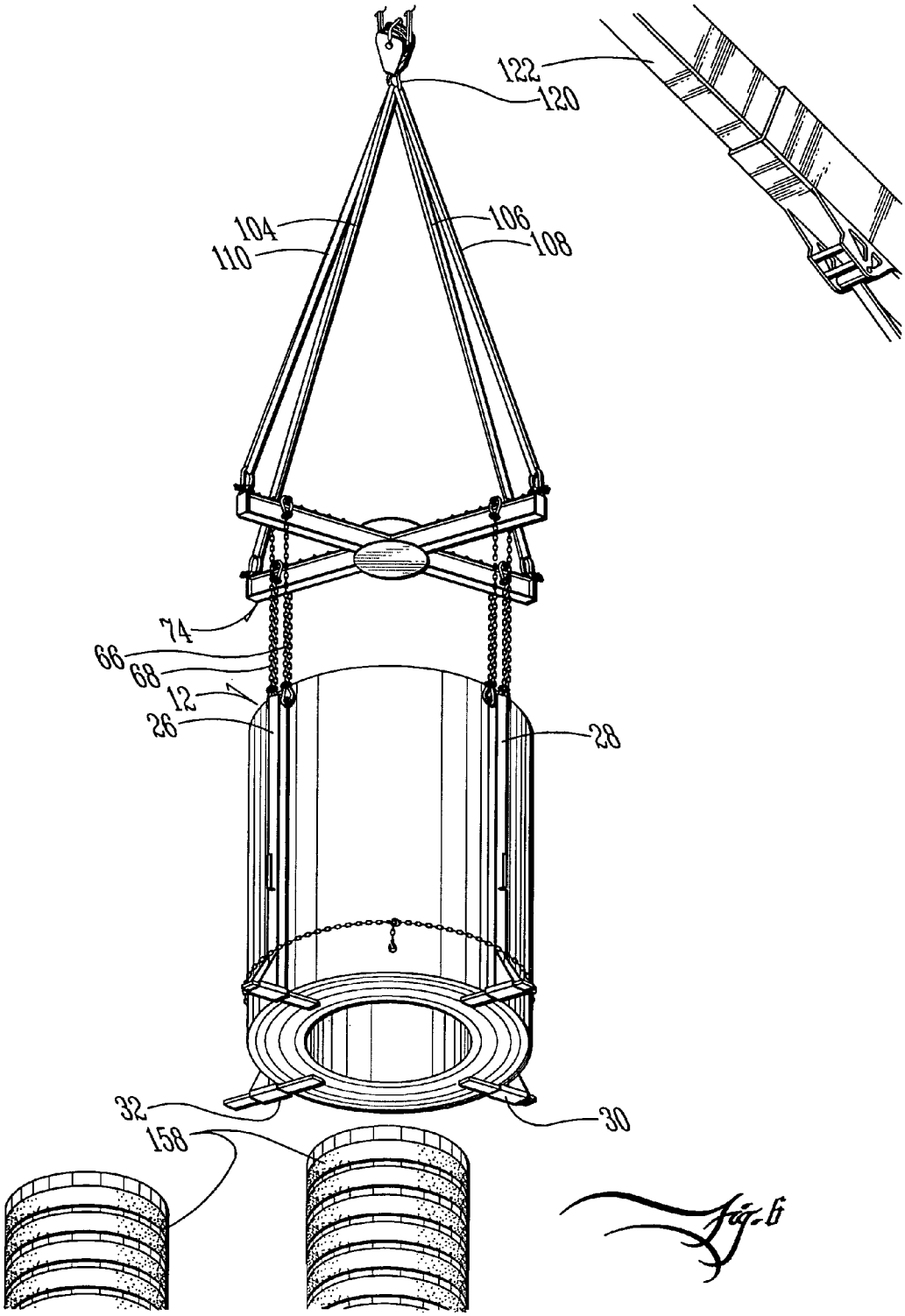
FIG. 6 is a bottom perspective view of the material handling system of the present invention lowering a coil transformer in onto a coil leg in accordance with one embodiment.

The first leg assembly (26) is provided with a coupling, such as a housing or shoe (34) defining a slot (36) of rectangular cross-section, sized to accommodate an extensible plate, such as a foot (38). The leg (26) is preferably between one half and eight meters tall, and more preferably between one and four meters tall. The foot (38) is a steel plate extending from both ends of the slot (36) and provided with an upwardly tapered forward face (40). While the foot (38) is preferably fully slidable within the slot (36) of the shoe (34), the shoe (34) may alternatively be provided with spring-loaded ball detents (42) extending slightly into the slot (36) to receive scallops (44) or other indentations on the foot (38). The detents (42) secure the foot (38) relative to the shoe (34) to allow the foot (38) to extend laterally relative to the leg (46) of the first leg assembly (26) a plurality of predetermined distances. FIG. 4.

The shoe (34) is welded to the leg (46) and is further secured thereto by a buttress, such as a pair of triangular plates (48) and (50) welded to the leg (46) and shoe (34). Preferably, the shoe (34) is welded to the leg (46) in a manner in which the shoe (34) extends laterally rearward relative to the leg (46) but has a forward face (52) coterminous with a forward face (54) of the leg (46). The leg (46) is a hollow steel tube having a rectangular cross-section.

An L-shaped bracket (58) constructed of steel is welded to the rearward face (56) of the leg (46). The top of the leg (46) is provided with a steel rod (60) passing through the leg (46) and provided on each of its threaded ends with a nut (62) and (64). Lift lines, such as a grade 100 lifting chains (66) and (68) are secured to the leg assembly (26). The lifting chains (66) and (68) are provided with slip hooks (70) and (72) which are secured around the threaded rod (60) and prevented from undesired disengagement by the nuts (62) and (64).

As shown in FIG. 1, a spacer (74) is provided above the transformer coil (12). The spacer (74) is constructed of a cruciform configuration of I-beams (76), (78) and (80). The spacer (74) is preferably between one-half and seven meters wide, and more preferably between one and four meters wide. Preferably two shorter I-beams (76) and (78) are welded, or otherwise secured, to a longer I-beam (80) to make the height of the spacer (74) the same as the width. Two circular steel support plates (82) and (84) are welded to the I-beams (76), (78) and (80) to provide the spacer (74) with additional strength. In the preferred embodiment, the spacer (74) is constructed to provide a lifting capacity of between five hundred and one-hundred thousand pounds, more preferably between one thousand and fifty thousand pounds, and most preferably between one thousand and thirty thousand pounds.

Provided on the tops of the I-beams (76), (78) and (80) are four steel hoist rings (86), (88), (90) and (92), welded or otherwise secured to the I-beams (76), (78) and (80). The tops (98) of the I-beams (76), (78) and (80) are provided with a plurality of stops (94) constructed of angle iron to provide the stops (94) with a triangular cross-section and peaks (96) rising approximately one inch from the tops (98) of the I-beams (76), (78) and (80). The stops (94) may be welded or otherwise secured to the tops (98) of the I-beams (76), (78) and (80), and spaced approximately four inches from one another. The center (100) of the spacer (74) may be provided with an additional hoist ring (102), welded or otherwise secured to the top of the support plate (82).

Coupled to the spacer (74) are a plurality of lifting straps (104), (106), (108) and (110). The straps (104-110) are secured to the spacer (74) by shackles (112), (114), (116) and (118) provided through the hoist rings (86), (88), (90) and (92). The straps (104-110) are coupled to the slip hook (120) of a crane (122) or other lifting device. Resting on the I-beams (76), (78) and (80) are steel rods (124), (126), (128) and (130) threaded on each end and provided with nuts (132), (134), (136), (138), (140), (142), (144) and (146), welded or otherwise secured against inadvertent removal from the rods (124-130). Provided over the rods (124) and (130) are slip hooks (148) coupled to the lifting chains (66) and (68). The downward force of the lifting chains (66) and (68) on the rods (124-130) keeps them from becoming dislodged from the spacer (74). The stops (94) keep the rods (124-130) from moving out of position along the I-beams (76), (78) and (80).

As shown in FIG. 1, provided around the leg assemblies (26-32) is a flexible connector such as a strap (150). In the preferred embodiment, the strap (150) is a grade 100 lifting chain provided on each end with a hoist hook (152) and (154). If desired, the strap (150) may be secured within the L-shaped brackets (58) of the leg assemblies (26-32), or the strap (150) may be simply provided around the leg assemblies (26-32), with the triangular plates (48) and (50) preventing the strap (150) from falling off the leg assemblies (26-32). If desired, the strap (150) may be provided around the end of the leg assemblies (26-32) and a supplemental strap (156) provided in the L-shaped brackets (58).

When it is desired to use the material handling system (10) of the present invention to lift a transformer coil (12), the leg assemblies (26-32) are positioned equal distance around the exterior cylinder (16). The foot (38) of each leg assembly (26-32) is moved a predetermined distance laterally relative to the forward face (54) of each leg (46). The distance which the foot (38) is moved laterally relative to the forward face (54) of the leg (46) is determined by the cylinder (16) and (22) desired to be lifted. If it is desired to lift just the exterior cylinder (16), the forward face (40) of the foot (38) is extended laterally relative to the forward face (54) of the leg (46) almost to the depth of the interior cylinder (22). If it is desired to lift all of the cylinders (16) and (22), the forward face (40) of the foot (38) is extended laterally relative to the forward face (54) of the leg (46) a sufficient distance to support all of the cylinders (16) and (22). The forward face (40) of the foot (38) preferably does not extend into the innermost interior of the innermost cylinder, to allow the transformer coil (12) to be placed over the core leg (158) without impediment by the foot (38). Once the foot (38) of each leg (46) has been positioned as desired under the transformer coil (12), the strap (150) is provided around the leg assemblies (26-32) and secured to itself using the hoist hooks (152) and (154). The supplemental strap (156) may be secured around the leg assemblies (26-32) within the L-shaped brackets (58) of the leg assemblies (26-32).

The slip hook (120) of the crane (122) is coupled to the straps (104-110) and the straps (104-110), in turn, are coupled to the hoist rings (86-92) of the spacer (74) by the shackles (112-118). Depending on the diameter of the transformer coil (12) the rods (124-130) are positioned on top of the I-beams (76-80) equidistant from the center of the spacer (74), and between two adjoining stops (94). For transformer coils (12) having a narrow diameter, the rods (124-130) are positioned closer to the center of the spacer (74) and for transformer coils (12) of a large diameter, the rods (124-130) are positioned further away from the center of the spacer (74). The stops (94) prevent the rods (124-130) from shifting laterally beyond the stops (94) between which they are positioned. The hoist rings (86-92) prevent the rods (124-130) from inadvertently moving off the ends of the I-beams (76-80). The lifting chains (66) and (68) are secured to the threaded rods (124-130) by the slip hooks (148) and are secured to the threaded rods (60) of the leg assemblies (26-32) by the slip hooks (70) and (72).

The material handling system (10) may then be lifted by the crane (122), allowing the transformer coil (12) to be lifted and positioned on or removed from the core leg (158). If it is desired to remove the exterior cylinder (16) of the transformer coil (12) from the interior cylinder (22) of the transformer coil (12), the foot (38) of each leg assembly (26-32) is adjusted accordingly to allow the material handling system (10) to lift the exterior cylinder (16) from the interior cylinder (22) and move to another location. Thereafter, the material handling system (10) may be disengaged from the exterior cylinder (16) and repositioned around the interior cylinder (22). As the interior cylinder (22) is provided with a smaller diameter than the exterior cylinder (16), the rods (124-130) are repositioned on the spacer (74) closer to the center of the spacer (74). The material handling system (10) may thereafter be lifted by the crane (122) to move the interior cylinder (22) to any desired location.

Although the invention has been described with respect to a preferred embodiment thereof, it is to be understood that it is not to be so limited since changes and modifications can be made therein which are within the full, intended scope of this invention as defined by the appended claims. For example, two, three or any desired number of leg assemblies may be used in association with the material handling system of the present invention.

What is claimed is:

1. A material handling system comprising:

(a) a leg;

(b) a foot;

(c) a coupling between the leg and the foot that secures the foot in a first position a first predetermined lateral distance from the leg and secures the foot in a second position a second predetermined lateral distance from the leg;

(d) wherein the leg is secured directly to the coupling;

(e) a buttress securing the leg to the coupling;

(f) a connector securing the leg against the material; and (g) a lift line coupled to the leg.

2. The material handling system of claim 1, further comprising a spacer coupled to the lift line.

3. The material handling system of claim 1, wherein the connector is flexible.

4. The material handling system of claim 1, wherein the foot is a plate.

5. The material handling system of claim 4, wherein the coupling is a housing defining a slot sized to accommodate the foot.

6. The material handling system of claim 1, further comprising a lift line spacer coupled to the lift line.

7. The material handling system of claim 6, wherein the lift line spacer is cruciform.

8. A material handling system comprising:

(a) a first leg;

(b) a first extensible foot coupled to the first leg;

(c) a first coupling between the first leg and the first extensible foot that secures the first extensible foot in a first position a first predetermined lateral distance from the first leg and secures the first extensible foot in a second position a second predetermined lateral distance from the first leg;

(d) wherein the first leg is coupled directly to the first coupling;

(e) a first buttress coupling the first leg to the first coupling;

(f) a second leg;

(g) a second extensible foot coupled to the second leg;

(h) a second coupling between the second leg and the second extensible foot that secures the second extensible foot in a first position a first predetermined lateral distance from the second leg and secures the second extensible foot in a second position a second predetermined lateral distance from the second leg;

(i) wherein the second leg is coupled directly to the second coupling;

(j) a second buttress coupling the second leg to the second coupling;

(k) a connector securing the first leg and the second leg against the material; and (l) a lift line coupled to the first leg.

9. The material handling system of claim 8, wherein the connector is flexible.

10. The material handling system of claim 9, wherein the first coupling is a shoe.

11. The material handling system of claim 10, wherein the first extensible foot is a plate provided within a slot defined by the first shoe.

12. The material handling system of claim 11, wherein the first foot is long enough to extend out of both ends of the slot simultaneously.

13. The material handling system of claim 8, further comprising a spacer coupled to the lift line.

14. The material handling system of claim 13, wherein the spacer is cruciform.

15. The material handling system of claim 8, wherein the first coupling is a shoe.

16. A material handling system comprising:

(a) a first leg assembly comprising:

(i) a first leg;

(ii) a first shoe coupled to the first leg, the first shoe defining a first slot;

(iii) a first foot provided within the first slot;

(iv) a first coupling between the first leg and the first extensible foot that secure the first extensible foot in a first position a first predetermined lateral distance from the first leg and secures the first extensible foot in a second position a second predetermined lateral distance from the first leg;

(v) wherein the first leg is coupled directly to the first coupling; and (vi) a first buttress coupling the first leg to the first coupling;

(b) a second leg assembly comprising:

(i) a second leg;

(ii) a second shoe coupled to the second leg, the second shoe defining a second slot;

(iii) a second foot provided within the second slot;

(iv) a second coupling between the second leg and the second extensible foot that secures the second extensible foot in a first position a first predetermined lateral distance from the second leg and secures the second extensible foot second position a second predetermined lateral distance from the second leg;

(v) wherein the second leg is coupled directly to the second coupling;

(vi) a second buttress coupling the second leg to the second coupling;

(c) a connector securing the first leg and the second leg against the material;

(d) a first lift line coupled to the first leg; and (e) a second lift line coupled to the second leg.

17. The material handling system of claim 16, further comprising:

(a) a third leg assembly comprising:

(i) a third leg;

(ii) a third shoe coupled to the third leg, the third shoe defining a third slot;

(iii) a third foot provided within the third slot;

(iv) a third coupling between the third leg and the third extensible foot that secures the third extensible foot in a third position a third predetermined lateral distance from the third leg and secures the third extensible foot in a third position a third predetermined lateral distance from the third leg; and (v) wherein the third leg is coupled directly to the third coupling;

(b) a fourth leg assembly comprising:

(i) a fourth leg;

(ii) a fourth shoe coupled to the fourth leg, the fourth shoe defining a fourth slot;

(iii) a fourth foot provided within the fourth slot;

(iv) a fourth coupling between the fourth leg and the fourth extensible foot that secures the fourth extensible foot in a fourth position a fourth predetermined lateral distance from the fourth leg and secures the fourth extensible foot in a fourth position a fourth predetermined lateral distance from the fourth leg;

(v) wherein the fourth leg coupled directly to the fourth coupling (c) a connector securing the first leg, the second leg, the third leg and the fourth leg against the material;

(d) a third lift line coupled to the third leg; and (e) a fourth lift line coupled to the fourth leg.

18. The material handling system of claim 16, further comprising a spacer coupled to the first line, the second line, the third line and the fourth line.

* * * * *